US007938653B2

(12) United States Patent
Hopwood et al.

(10) Patent No.: US 7,938,653 B2
(45) Date of Patent: May 10, 2011

(54) ELECTRICAL PLUG DEVICE WITH FOLDING BLADES

(75) Inventors: Keith Hopwood, Fremont, CA (US); Chang Chun Feng, Taoyuan (TW)

(73) Assignee: Phihong USA Corporation, Fremont, CA (US)

( * ) Notice: Subject to any disclaimer, the term of this patent is extended or adjusted under 35 U.S.C. 154(b) by 0 days.

(21) Appl. No.: 12/467,926

(22) Filed: May 18, 2009

(65) Prior Publication Data

US 2010/0291779 A1 Nov. 18, 2010

(51) Int. Cl.
*H01R 13/44* (2006.01)

(52) U.S. Cl. ..... 439/131

(58) Field of Classification Search ..... 439/131, 439/171–175

See application file for complete search history.

(56) References Cited

U.S. PATENT DOCUMENTS

| | | | | |
|---|---|---|---|---|
| D374,657 | S | 10/1996 | Beranek | |
| D378,290 | S | 3/1997 | Hahn | |
| D378,291 | S | 3/1997 | Hahn | |
| 5,613,863 | A * | 3/1997 | Klaus et al. | 439/131 |
| D379,003 | S | 4/1997 | Hahn | |
| D381,314 | S | 7/1997 | Hahn | |
| D382,540 | S | 8/1997 | Hahn | |
| D454,537 | S | 3/2002 | O'Connor et al. | |
| 6,638,113 | B2 | 10/2003 | Kajiwara et al. | |
| D556,138 | S | 11/2007 | Ng | |
| D596,572 | S | 7/2009 | Wu et al. | |
| D599,738 | S | 9/2009 | Amidei et al. | |
| D621,782 | S | 8/2010 | Chang et al. | |
| 2002/0081906 | A1 | 6/2002 | Kajiwara et al. | |
| 2002/0090848 | A1 | 7/2002 | Yu | |
| 2002/0119687 | A1 | 8/2002 | Wen-Ching | |
| 2004/0209499 | A1 | 10/2004 | Chung | |

FOREIGN PATENT DOCUMENTS

TW D130798 9/2009

OTHER PUBLICATIONS

International Search Report from corresponding International Application No. PCT/US2010/034977 mailed Nov. 30, 2010.
Search Report dated Dec. 7, 2010 from ROC (Taiwan) Design Patent Appln. No. 098305463.

* cited by examiner

*Primary Examiner* — Ross N Gushi
(74) *Attorney, Agent, or Firm* — Fish & Richardson P.C.

(57) ABSTRACT

An electrical plug device includes a housing, support members coupled to the housing and electrically conductive members, each supported by one of the support members. The support members are able to rotate about respective axes so that the electrically conductive members can move between a closed position with the electrically conductive members folded into a trough in the housing and an open position with the electrically conductive members extended out of the housing. An elastic member is coupled to the housing to engage one or more of the support members when the electrically conductive members are in the open position or the closed position. Rotation of the support members from the open or closed positions is inhibited by the engagement of the elastic member and the one or more support members.

16 Claims, 5 Drawing Sheets

ELECTRICAL PLUG DEVICE WITH FOLDING BLADES

FIELD OF THE DISCLOSURE

This disclosure relates to an electrical plug device and, more particularly, to an electrical plug device with folding blades.

BACKGROUND

Electrical plug devices are adapted to removably connect electrically-operated devices to an electrical power outlet. In a typical implementation, the electrical power outlet is adapted to receive electrical power from a commercial power supply. An electrical charger circuit for a mobile telephone, a personal digital assistant or the like, may include an electrical plug device.

SUMMARY OF THE DISCLOSURE

In one aspect, an electrical plug device includes folding blades that tend to stay in either an open position or a closed position absent the application of some externally-applied force to disengage the blades from those positions.

In another aspect, an electrical plug device includes a housing, support members coupled to the housing and electrically conductive members, each supported by one of the support members. The support members are able to rotate about respective axes so that the electrically conductive members can move between a closed position with the electrically conductive members folded into a trough in the housing and an open position with the electrically conductive members extended out of the housing. An elastic member is coupled to the housing to engage one or more of the support members when the electrically conductive members are in the open position or the closed position. Rotation of the support members from the open or closed positions is inhibited by the engagement of the elastic member and the one or more support members.

In some implementations, the elastic member is arranged so that when the elastic member is engaged with the one or more support members and a torque is applied to one or more of the support members, the elastic member elastically deforms in response to the applied torque. The elastic deformation is sufficiently great to allow the elastic member to bend and thereby release the one or more support members from engagement.

According to some embodiments, the support members are substantially free to rotate about their respective axes when the elastic member is not engaged with the one or more support members. The elastic member typically is arranged to engage the one or more support members when the conductive members are in the extended position and when the conductive members are in the retracted position.

In certain embodiments, the support members have a first support member and a second support member. In those embodiments the elastic member is arranged to engage both the first support member and second support member. The elastic member can include a substantially T-shaped body.

According to some implementations, at least one of the support members has surfaces that define one or more notches sized to corresponding portions of the elastic member. In those implementations, the elastic member includes one or more portions arranged to fit into the one or more notches in the support members when the electrically conductive members are in the extended position or in the retracted position.

In some embodiments, the electrically conductive members are rotatable approximately 90 degrees between the substantially extended position and the substantially retracted position. The electrical plug device can include an electrical charge circuit inside the housing and electrically coupled to the electrically conductive members. The support members can be electrically conductive.

According to certain implementations, the electrical plug device includes elastic members, each of which is arranged to engage one or more of the support members when the electrically conductive members are in the extended position or the retracted position to inhibit thereby rotation of the engaged one or more support members.

Typically, the electrically conductive members include two substantially flat blades. The support members can be coupled to one another by a substantially rigid linkage element arranged so that when one of the support members is rotated, the other of the support members rotates as well.

Features of the various aspects are combined in some implementations. In some implementations, one or more of the following advantages are present.

Inadvertent movement of the conductive elements (e.g., blades) can be prevented or at least reduced. Accordingly, the likelihood of the plug device's conductive blades becoming damaged may be reduced.

Moreover, when a user engages the conductive blades in an open or closed position, this can produce an audible or otherwise noticeable click to alert the user that the engagement is complete and that, therefore, the blades' positions are likely to be maintained absent the application of some deliberate force to disengage the conductive elements from their positions.

The foregoing features and others are realized by a relatively simple configuration of elements that is easy to manufacture.

Other features and advantages will be apparent from the description and drawings, and from the claims.

BRIEF DESCRIPTION

DETAILED DESCRIPTION

Figure 1C:
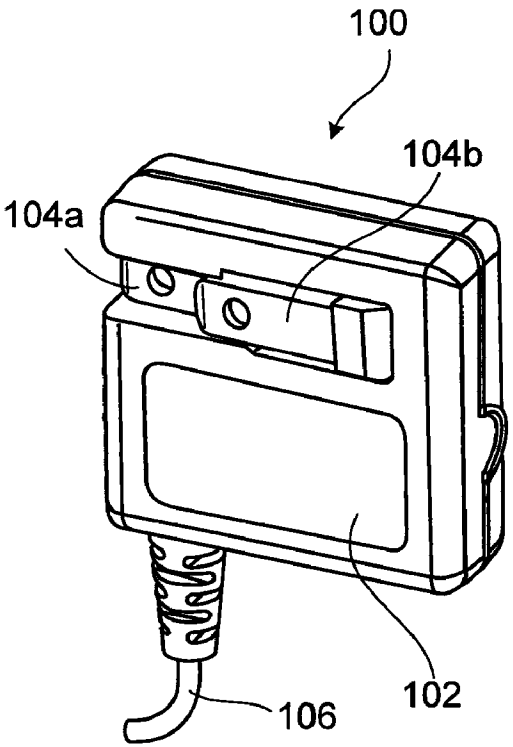
FIGS. 1A to 1C are partial front perspective views of an electrical plug device.
Figure 1B:
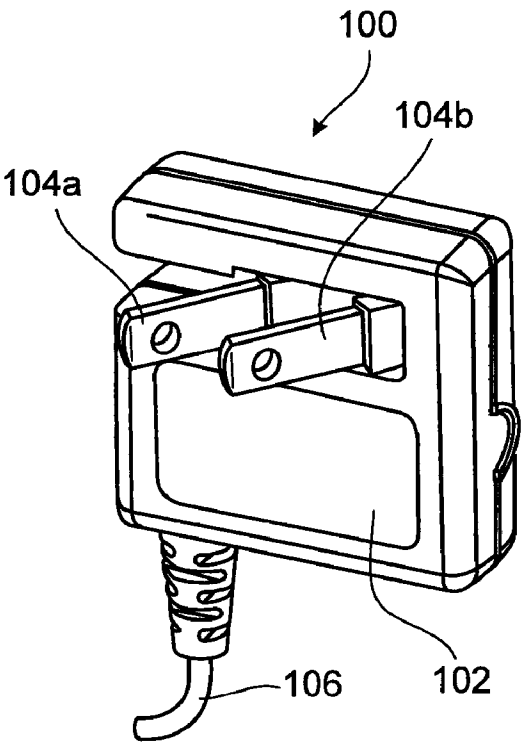
Figure 1A:
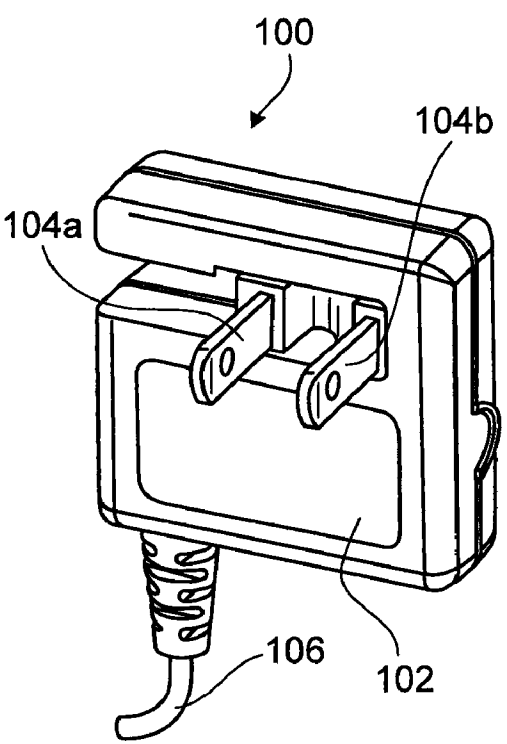

FIGS. 1A-1C are front perspective views of an electrical plug device 100 that includes a housing 102 and a pair of electrically conductive members, which in the illustrated implementation is a pair of conductive blades 104*a*, 104*b*.

The conductive blades 104*a*, 104*b* can move between an open position (shown in FIG. 1A), in which the conductive blades 104*a*, 104*b* physically extend out of the housing 102, and a closed position (shown in FIG. 1C), in which the conductive blades 104*a*, 104*b* are folded into a trough 106 in the housing 102. In the open position (FIG. 1A), the conductive blades 104*a*, 104*b* are arranged so as to be able to be plugged into an electrical socket, for example, into a wall outlet or electrical adapter. In the closed position (FIG. 1C), the conductive blades 104*a*, 104*b* are folded into the trough 106 and substantially protected by the housing 102 from becoming damaged by physically impacting other items. FIG. 1B shows the conductive blades 104*a*, 104*b* in an intermediate position between the open position (FIG. 1A) and the closed position (FIG. 1C).

As discussed herein, the illustrated electrical plug device 100 has provisions that help maintain the conductive blades 104*a*, 104*b* in either the open position (FIG. 1A) or the closed position (FIG. 1C), so that moving the conductive blades 104*a*, 104*b* from these positions requires the application of some, albeit fairly minimum, force. Therefore, when the conductive blades 104*a*, 104*b* are in either the open or closed position, they tend to stay in those positions.

This is desirable for a number of reasons. If, for example, the electrical plug device 100 is being carried in a person's bag, then it may be desirable to have the conductive blades in the closed position (FIG. 1C) and to reduce the possibility that the conductive blades might accidentally move to the open position (FIG. 1A) or intermediate position (FIG. 1B). This can help prevent the blades from becoming bent, twisted or broken, by impacting other items in the bag or otherwise being banged around. Additionally, if the conductive blades are in the open position and a person is attempting to insert the blades into electrical sockets, maintaining the blades 104*a*, 104*b* in the open position will help keep the blades properly aligned relative to the sockets. This can, in certain instances, reduce the likelihood that the blades 104*a*, 104*b* might become damaged (e.g., bent), which could occur if, for example, the blades 104*a*-104*b* were misaligned and were forced into the sockets.

In the illustrated implementation, once the conductive blades 104*a*, 104*b* are disengaged from either the open or closed position, the conductive blades 104*a*, 104*b* are relatively free to swing about their respective axes. This is shown in FIG. 1C, for example, where the blades are positioned between the open position and closed position. The amount of force required to disengage the blades from the open position or the closed position is minimal, but is more than the amount of force (torque) required to move the blades when they are disengaged from the open or closed positions. Typically, a sufficient amount of force (torque) to disengage can easily be applied by a person using the tip of his or her finger(s) to lightly push against the blades in an appropriate direction. Similarly, a fairly small amount of force (torque) is required to engage the blades 104*a*, 104*b* to either the open or closed positions, but this force (torque) too is more than the force (torque) required to move the blades when they are disengaged from the open or closed positions. Indeed, a sufficient amount of force (torque) to engage easily can be applied by a person using the tip of his or her finger(s) to lightly push against either blade 104*a*, 104*b* in an appropriate direction.

In some implementations, the electrical plug device 100 includes a charge circuit and is operable as a compact electrical charger for a mobile phone, a personal digital assistant, a laptop computer or the like. In such implementations, the conductive blades 104*a*, 104*b* are electrically connected to supply electrical current to an input of the charge circuit and the electrical power cord 106, part of which is shown in FIGS. 1A-1C, is be electrically connected to an output of the charge circuit. The electrical power cord 106 is connected to the device intended to be charged.

Figure 2A:
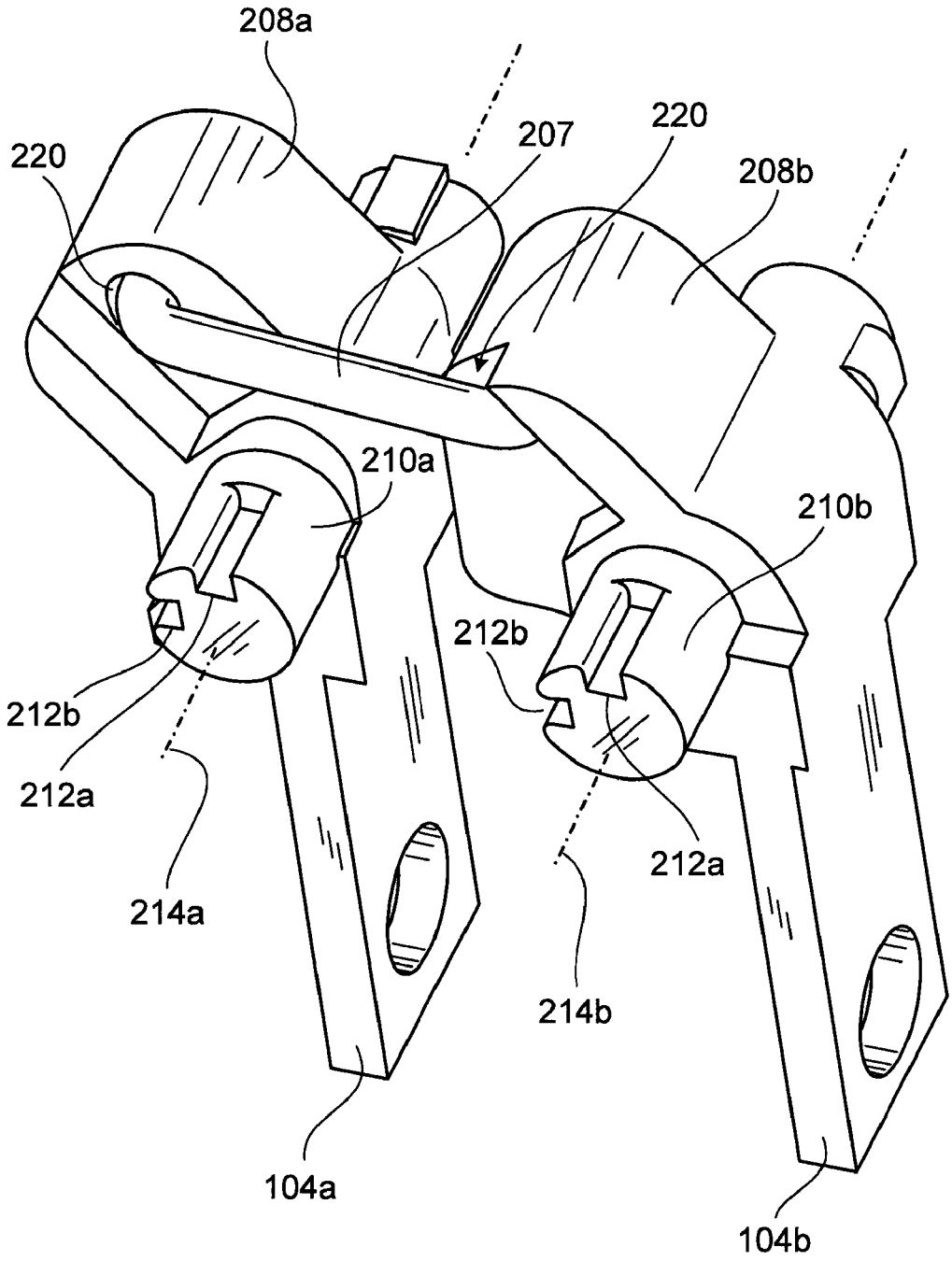
FIGS. 2A and 2C are partial assembly views of an electrical plug device.
Figure 2B:
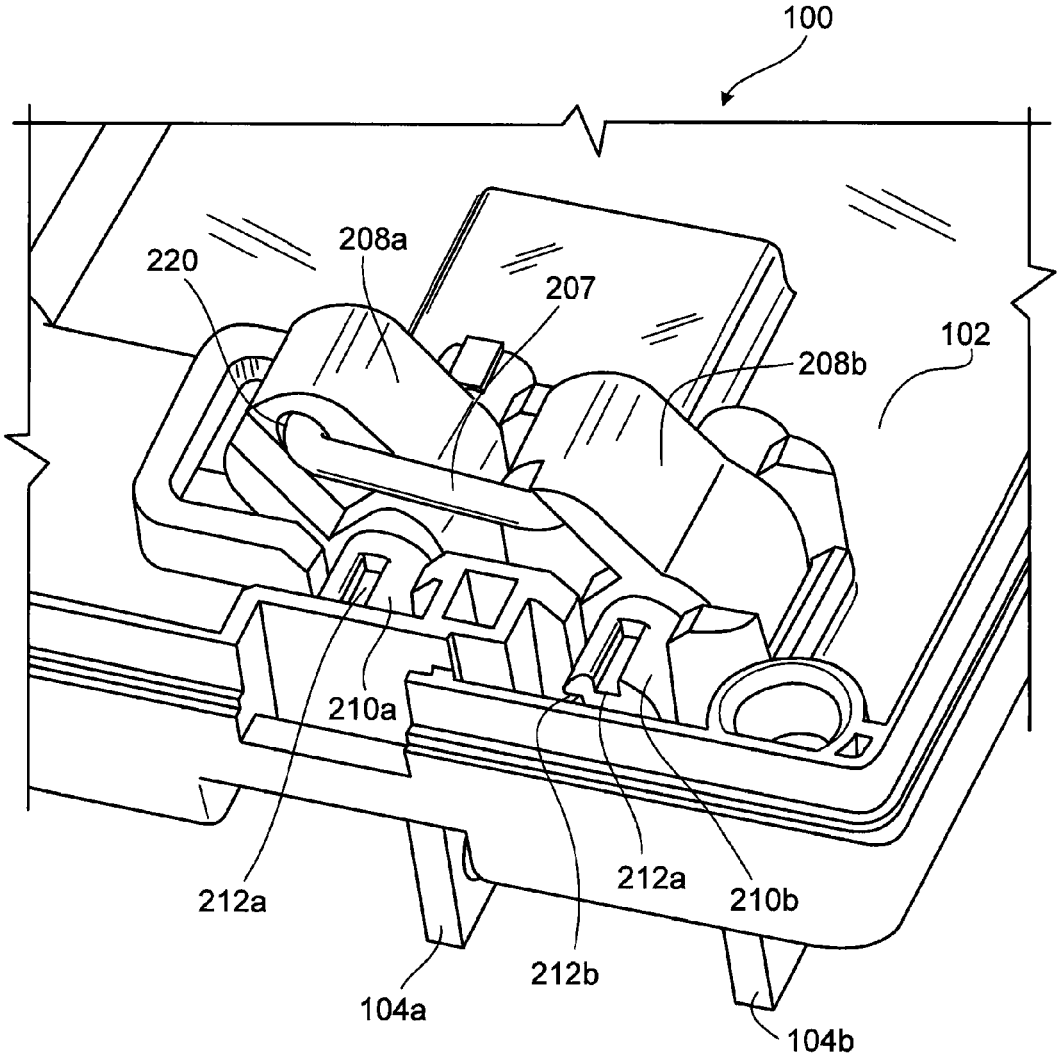

FIGS. 2A and 2B are partial assembly views of the electrical plug device 100.

FIG. 2A shows the pair of conductive blades 104*a*, 104*b*, associated support members 208*a*, 208*b* for each conductive blade 104*a*, 104*b* and a link 207 coupling the support members 210 to one another. FIG. 2B shows the assembly of FIG. 2A coupled to part of the electrical plug device's 100 housing 102.

Referring to FIG. 2A, the conductive blades 104*a*, 104*b* are integrally formed with their respective support members 208*a*, 208*b*. Each support member 208*a*, 208*b* includes an extension member 210*a*, 210*b* that is substantially cylindrical and has a pair of notches 212*a*, 212*b* formed therein. In the illustrated implementation, each notch 212*a*, 212*b* extends axially along its associated cylindrical extension member 210*a*, 210*b* from a far end thereof. In each support member 208*a*, 208*b*, the notches 212*a*, 212*b* are displaced from one another by approximately 90 degrees about the perimeter of the cylindrical extension member. Each support member 210 also defines an opening 220 sized to receive one end of the link 207.

The link 207 is a substantially rigid element that is bent at both ends thereof in substantially the same direction. The bent ends of the link 207 extend into the holes 220 in the support members 210. The link 207 translates the motion of one conductive blade to the other conductive blade so that the two conductive blades 104*a*, 104*b* move together. The diameter of the bent ends of the link 207 is somewhat smaller than the holes 220 they extend into so that the engagement of the link 207 to the holes 220 does not unduly restrict the motion of the conductive blades 104.

In some implementations, each conductive blade 104*a*, 104*b* and its associated support member 208*a*, 208*b* is arranged to rotate about its particular axis 214*a*, 214*b* of rotation.

Referring now to FIG. 2B, when assembled as part of an electrical plug device 100, the support members 208*a*, 208*b* are coupled to the housing 102 in such a manner that the support members 208*a*, 208*b* and their associated conductive blades 104*a*, 104*b* can rotate about their respective axes 214*a*, 214*b*. Moreover, the cylindrical portion of each extension piece 216*a*, 216*b* is centered on its associated axis 214*a*, 214*b*.

The housing 102 is contoured to define an aperture 222 that can support an elastic element (shown as element 330 in FIGS. 3A and 3B), which engages the notches 218 to facilitate maintaining the blades in the open and/or closed positions absent some applied force (torque).

Figure 3A:
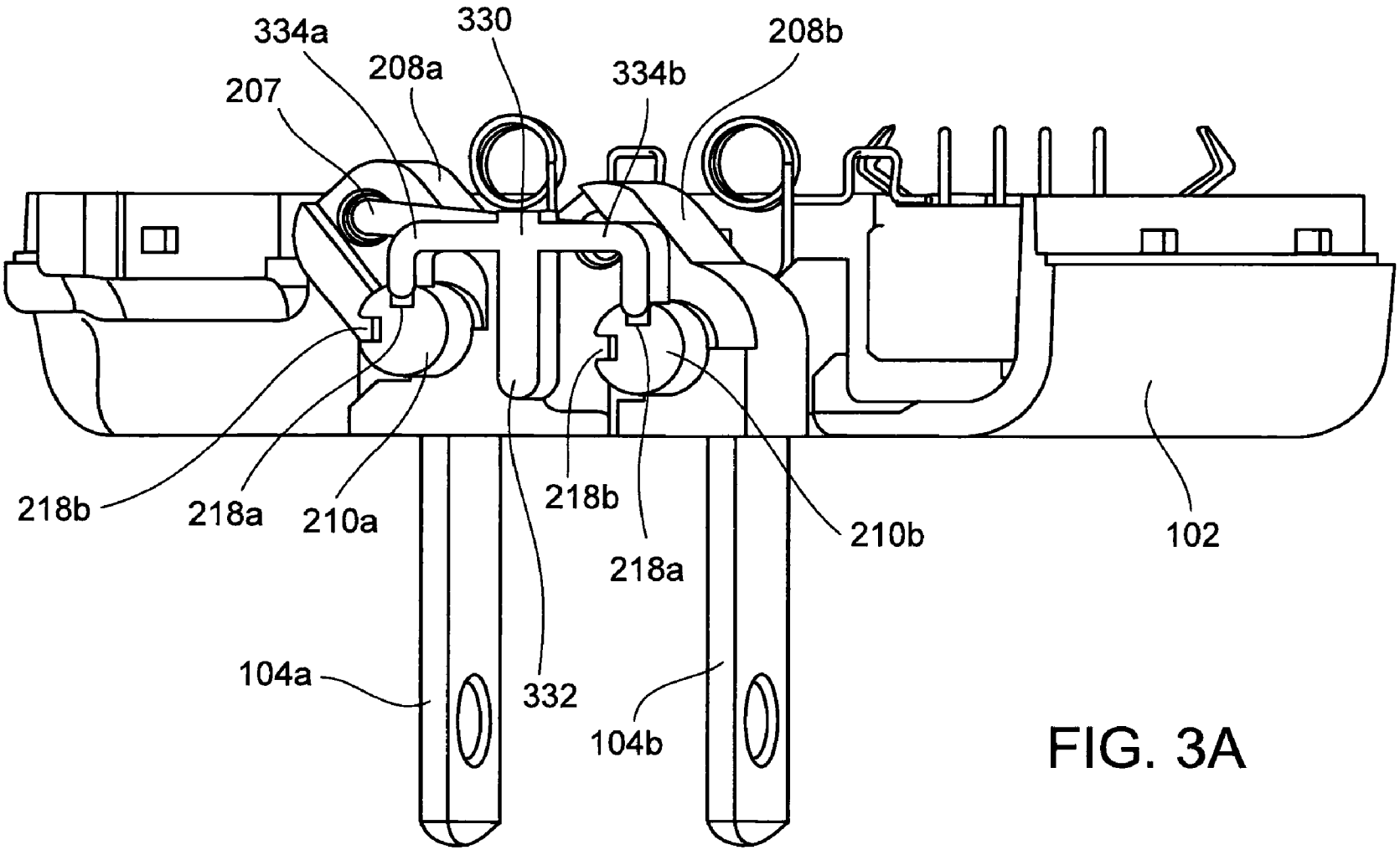
FIGS. 3A and 3B are partial cross-sectional views of an electrical plug device.
Figure 3B:
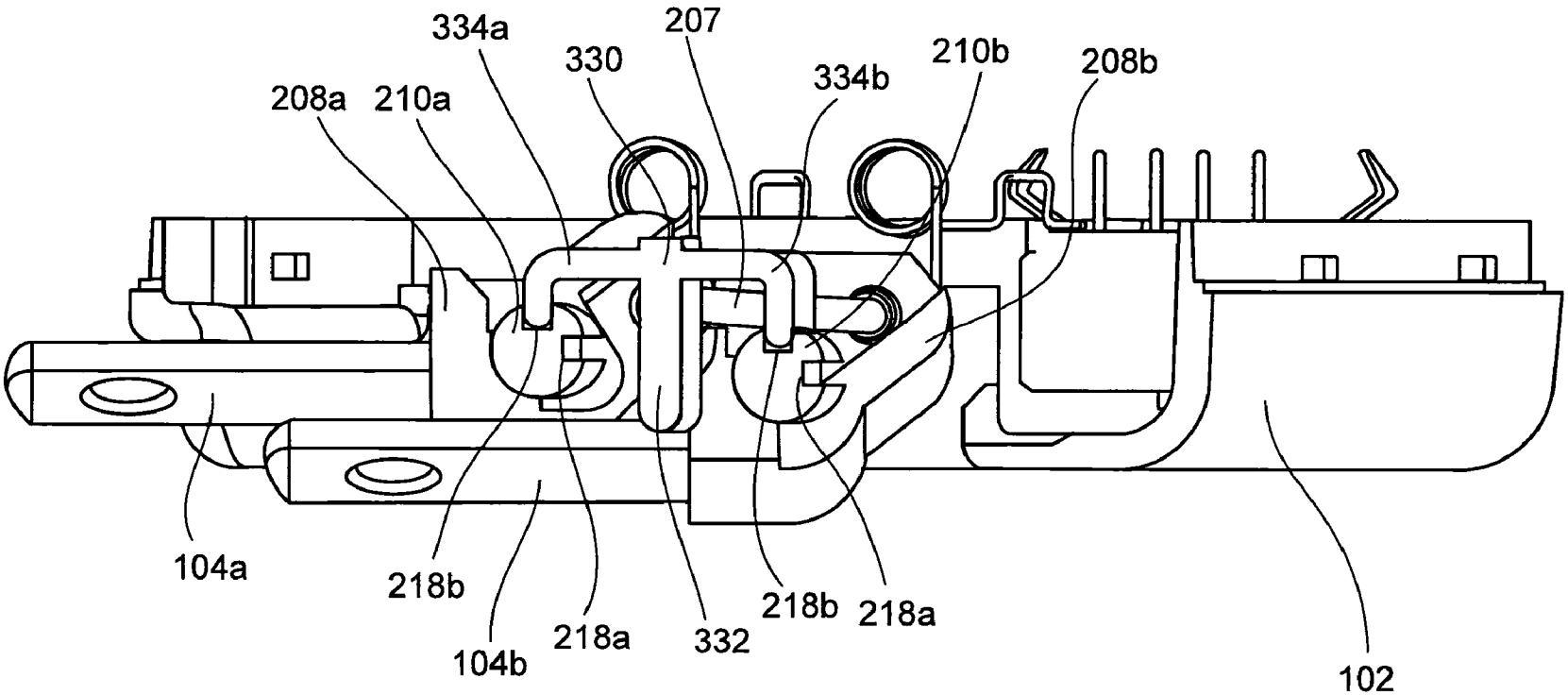

FIGS. 3A and 3B are partial cutaway views of the electrical plug device 100 showing an elastic member 330 that can engage the notches 218*a*, 218*b* in each cylindrical portion of the support elements 210 to facilitate maintaining the blades in the open and/or closed positions absent some applied force (torque). In some implementations, the elastic member is made of a plastic material. The illustrated elastic member 330 is substantially T-shaped and has a sufficient amount of elasticity such that its shape can deform somewhat and substantially return to its original shape, as shown in FIGS. 3A and 3B. The illustrated elastic member has a support arm 332 and a pair of notch-engagement arms 334*a*, 334*b* that extend outwardly from the support arm 332. The far end of each notch-engaging arm 334*a*, 334*b* is bent approximately 90 degrees in the same direction toward an associated one of the extension members 210*a*, 210*b*. The far tip of each notch-engaging arm 334*a*, 334*b* is rounded in one direction so as to facilitate engaging and disengaging the notches.

In assembly, the elastic member 330 is rigidly supported by the housing 102 so that, whenever there is no force being applied to deform the elastic member 330 (or part of the elastic member 330), the elastic member 330 returns to the same shape and configuration relative to the housing 102. In the illustrated implementation, the support arm 332 of the elastic member 330 fits into and is securely held in the aperture 222 (see FIG. 2B) of housing 102. In this implementation, the notch-engaging arms 334*a*, 334*b*, which extend outward from the support arm 332 in opposite directions, are considerably more free than the support arm 332 to flex and bend relative to the housing.

In FIG. 3A, the conductive blades 104*a*, 104*b* are shown in the open position and the far tip of each notch-engaging arm 334*a*, 334*b* is engaged in one of the notches 218*a* in each support element 208*a*, 208*b*. In the illustrated implementation, the engagement of the far tips of the notch-engaging arms 334*a*, 334*b* and notches 218*a* helps maintain the conductive blades 104*a*, 104*b* in the open position shown.

When a force is applied to the conductive blades 104*a*, 104*b* tending to move the blades in a clockwise direction out of the open position, the far ends of each notch-engaging arm 334*a*, 334*b* flex a bit to allow the extension members 210*a*, 210*b* to rotate a sufficient amount that the far ends of the notch-engaging arms can be released from their engagement with the notches. Once released, it is relatively easy to rotate the conductive blades 104*a*, 104*b* in the clockwise direction toward the closed position. During this time, the far tips of the notch-engaging arms 334*a*, 334*b* ride along the outer perimeter of the cylindrical extension members 210*a*, 210*b* until they reach the other notch 218*b*. When they reach the other notch 218*b*, the far tips of the notch-engaging arms 334*a*, 334*b* engage this notch 218*b*.

In FIG. 3B, the conductive blades 104*a*, 104*b* are shown in the closed position and the far tip of the notch-engaging arms 334*a*, 334*b* are engaged in notches 218*b* of each support element 208*a*, 208*b*. In the illustrated implementation, engagement of the far tips of the notch-engaging arms 334*a*, 334*b* and the notches 218*b* helps maintain the conductive blades 104*a*, 104*b* in the closed position shown.

A number of embodiments of the invention have been described. Nevertheless, it will be understood that various modifications may be made without departing from the spirit and scope of the invention.

For example, the elastic member can be a different shape than what is shown in the figures. Moreover, the elastic member can be arranged to engage only one, but not the other, support element. The elastic member can be formed so that only part of it is elastic, while another part of it is substantially rigid. For example, in some implementations, the support arm of the elastic member is substantially rigid and the notch-engaging arms are more pliable or more elastic in comparison.

Additionally, in some implementations the support members differ from the description above. For example, the support members can include a single notch, instead of two notches. In such implementations, the single notch can help maintain the conductive blades in either the open or closed position, but not both. The notches can have a variety of sizes and shapes. The support members can be made, for example, of an electrically conductive material or may be partly non-conductive. For example, the extension pieces, where the notches are formed, need not be electrically conductive. If partly non-conductive, then provisions would be made to carry electricity from the electrically conductive blades to the internal circuitry of the plug device.

The conductive elements can take a variety of sizes and shapes. These can be configured in any way convenient to plug into a socket of any style. In some implementations, the concepts disclosed herein can be adapted for use with a plug device that has more than two externally exposed conductive elements.

The electrical plug device can be, for example, a charger or any other kind of electrical device with foldable blades exposed for plugging into an electrical socket.

Other implementations are within the scope of the claims.

What is claimed is:

1. An electrical plug device comprising:

a housing;

support members coupled to the housing;

electrically conductive members, each supported by one of the support members, wherein each support member is rotatable about a different axis to enable the electrically conductive members to move between a closed position with the electrically conductive members folded into a trough in the housing and an open position with the electrically conductive members extended out of the housing;

an elastic member coupled to the housing to engage one or more of the support members when the electrically conductive members are in the open position or the closed position, wherein rotation of the support members from the open or closed positions is inhibited by engagement of the elastic member with the one or more support members.

2. The electrical plug device of claim 1 wherein the elastic member is arranged so that when the elastic member is engaged with the one or more support members and a torque is applied to one or more of the support members, the elastic member elastically deforms in response to the applied torque, and wherein the elastic deformation is sufficiently great to allow the elastic member to bend and thereby release the one or more support members from engagement.

3. The electrical plug device of claim 2 wherein each support member is substantially free to rotate about its axis when the elastic member is not engaged with the one or more support members.

4. The electrical plug device of claim 1 wherein the elastic member is arranged to engage the one or more support members when the conductive members are in the extended position and when the conductive members are in the retracted position.

5. The electrical plug device of claim 1 wherein the support members comprise a first support member and a second support member, and wherein the elastic member is arranged to engage both the first support member and second support member.

6. The electrical plug device of claim 5 wherein the elastic member comprises a substantially T-shaped body.

7. The electrical plug device of claim 1 wherein at least one of the support members has surfaces that define one or more notches sized to corresponding portions of the elastic member; and wherein the elastic member includes portions arranged to fit into the one or more notches in the support members when the electrically conductive members are in the extended position or in the retracted position.

8. The electrical plug device of claim 1 wherein the electrically conductive members are rotatable approximately 90 degrees between the substantially extended position and the substantially retracted position.

9. The electrical plug device of claim 1 further comprising an electrical charge circuit inside the housing and electrically coupled to the electrically conductive members.

10. The electrical plug device of claim 1 wherein the support members are electrically conductive.

11. The electrical plug device of claim 1 comprising:

a plurality of elastic members, each of which is arranged to engage one or more of the support members when the electrically conductive members are in the extended position or the retracted position to inhibit thereby rotation of the engaged one or more support members.

12. The electrical plug device of claim 1 wherein the electrically conductive members comprise two substantially flat blades.

13. The electrical plug device of claim 12 wherein the two substantially flat blades are arranged such that, in the closed position, one of the substantially flat blades extends partially over another of the substantially flat blades.

14. The electrical plug device of claim 1 wherein the support members are coupled to one another by a substantially rigid linkage element arranged so that when one of the support members is rotated, the other of the support members rotates as well.

15. The electrical plug device of claim 1 wherein the electrically conductive members move closer together when the electrically conductive members are moved from the open position to the closed position.

16. An electrical plug device comprising:

a housing;

support members coupled to the housing;

two substantially flat blades, each supported by one of the support members, wherein each support member is rotatable about a different axis to enable the substantially flat blades move between a closed position with the substantially flat blades folded into a trough in the housing and an open position with the substantially flat blades extended out of the housing;

an elastic member coupled to the housing to engage one or more of the support members when the substantially flat blades are in the open position or the closed position, wherein rotation of the support members from the open or closed positions is inhibited by engagement of the elastic member with the one or more support members, wherein the substantially flat blades are arranged such that, in the closed position, one of the substantially flat blades extends partially over another of the substantially flat blades, and wherein the substantially flat blades moves closer together when the substantially flat blades are moved from the open position to the closed position.

* * * * *

UNITED STATES PATENT AND TRADEMARK OFFICE

CERTIFICATE OF CORRECTION

PATENT NO. : 7,938,653 B2
APPLICATION NO. : 12/467926
DATED : May 10, 2011
INVENTOR(S) : Keith Hopwood et al.

It is certified that error appears in the above-identified patent and that said Letters Patent is hereby corrected as shown below:

On the title page, item [75] (Inventors), delete "Chang Chun Feng" and insert --Chun Feng Chang--.

Signed and Sealed this
Thirteenth Day of September, 2011

David J. Kappos

David J. Kappos
*Director of the United States Patent and Trademark Office*